US008461441B2

(12) United States Patent
Miloslavsky

(10) Patent No.: US 8,461,441 B2
(45) Date of Patent: Jun. 11, 2013

(54) STRINGED INSTRUMENTS WITH INTERNAL BAFFLING

(76) Inventor: Gennady Miloslavsky, Brooklyn, NY (US)

( * ) Notice: Subject to any disclaimer, the term of this patent is extended or adjusted under 35 U.S.C. 154(b) by 0 days.

(21) Appl. No.: 13/198,048

(22) Filed: Aug. 4, 2011

(65) Prior Publication Data

US 2013/0032019 A1 Feb. 7, 2013

(51) Int. Cl.
*G10D 13/02* (2006.01)

(52) U.S. Cl.
USPC ..... 84/421; 84/327

(58) Field of Classification Search
USPC ..... 84/267, 291
See application file for complete search history.

(56) References Cited

U.S. PATENT DOCUMENTS

| | | | | | |
|---|---|---|---|---|---|
| D29,666 | S | * | 11/1898 | Hagberg | D17/14 |
| 812,049 | A | * | 2/1906 | Krueger | 84/267 |
| 860,137 | A | * | 7/1907 | Inskeep | 84/294 |
| 1,001,302 | A | * | 8/1911 | Rauch | 84/291 |
| 1,183,369 | A | * | 5/1916 | Gardie | 84/263 |
| 1,733,595 | A | * | 10/1929 | Greenfield | 84/267 |
| 1,834,804 | A | * | 12/1931 | Puoina | 84/267 |
| 1,961,152 | A | * | 6/1934 | Larson | 84/376 R |
| 2,816,619 | A | * | 12/1957 | Karlson | 181/148 |
| 2,953,052 | A | * | 9/1960 | Newton | 84/743 |
| 3,188,902 | A | * | 6/1965 | Levasseur | 84/291 |
| 3,357,291 | A | * | 12/1967 | Carmichael | 84/267 |
| 3,555,956 | A | * | 1/1971 | Martin | 84/400 |
| 3,908,503 | A | * | 9/1975 | Bolin | 84/743 |
| 4,467,692 | A | * | 8/1984 | Egan | 84/291 |
| 4,539,886 | A | * | 9/1985 | Hoffart | 84/267 |
| 4,790,228 | A | * | 12/1988 | Thirion | 84/411 R |
| 4,903,567 | A | * | 2/1990 | Justus | 84/294 |
| 6,087,569 | A | * | 7/2000 | Gottschall | 84/291 |
| 6,639,134 | B2 | * | 10/2003 | Schmidt | 84/291 |
| 6,664,454 | B1 | * | 12/2003 | Johnson | 84/383 R |
| 6,777,601 | B1 | * | 8/2004 | Kerfoot | 84/291 |
| 7,074,992 | B2 | * | 7/2006 | Schmidt | 84/294 |
| 7,342,158 | B2 | * | 3/2008 | Olson | 84/173 |
| 7,579,534 | B1 | * | 8/2009 | Ryan | 84/291 |
| 7,754,951 | B2 | * | 7/2010 | Thornhill | 84/294 |
| 2005/0076763 | A1 | * | 4/2005 | Langeman | 84/290 |

* cited by examiner

*Primary Examiner* — David Warren
*Assistant Examiner* — Robert W Horn
(74) *Attorney, Agent, or Firm* — Antonio Papageoriou; Ostrow Kaufman LLP

(57) ABSTRACT

A musical instrument with a hollow body is provided that has a top and a bottom, and at least one vertical baffle forming a meandering path within the hollow body of the musical instrument between the top and bottom of the hollow body. The hollow body of the musical instrument may further include a planer baffle located within the hollow body such that a separation chamber created therewith separates the soundboard of the musical instrument from the meandering path and the planer baffle maintains the volume of the meandering path such that the at least one vertical baffle does not interfere with vibration of the soundboard.

14 Claims, 6 Drawing Sheets

STRINGED INSTRUMENTS WITH INTERNAL BAFFLING

BACKGROUND

The present application relates to stringed instruments, and more particularly to methods and systems for baffling acoustic string instruments.

Acoustic stringed instruments, such as guitars, generally have a hollow body with strings that extend longitudinally from the top end, e.g., the headstock, to some point near on at the bottom end, e.g., the bridge or tail block, of the instrument. Between the ends of the strings lies a bridge that maintains the strings a certain distance above the soundboard of the stringed instrument. When the strings of the instrument are manipulated, the vibration created in the strings is transferred to the soundboard to amplify the sound of the strings. Acoustic string instruments, however, are limited with regard to the loudness that may be produced and the frequency and/or the amplitude of the sound produced without electronic amplification/enhancement. Accordingly, there is a need for methods and system to increase the loudness or vary the frequency and/or the amplitude of the sound of sound produced from an acoustic string instrument without electronic amplification/enhancement.

SUMMARY

In one embodiment, a hollow body of a musical instrument is provided, the hollow body comprising a top and a bottom, and at least one vertical baffle forming a meandering path within the hollow body of the musical instrument between the top and bottom of the hollow body.

In one embodiment, the top of the hollow body comprises a soundboard of a stringed instrument and wherein the at least one vertical baffle directs sound created with the soundboard through the meandering path within the hollow body of the instrument.

In one embodiment, the hollow body of a musical instrument comprises a planer baffle located within the hollow body such that a separation chamber created therewith separates the soundboard from the meandering path and the planer baffle maintains the volume of the meandering path such that the at least one vertical baffle does not interfere with vibration of the soundboard.

In one embodiment, the planer baffle is one of parallel with a plane of the sound board or tilted relative to the plane of the sound board.

In one embodiment, the meandering path has a length and a cross sectional area that increases between an inlet aperture of the meandering path and an exit of the meandering path.

In one embodiment, the cross sectional area further creates an outwardly increasing taper at least at the exit of the meandering path.

In one embodiment, the length of the meandering path is one of ¼ and ½ of an average wavelength sound created with the musical instrument.

In one embodiment, the at least one vertical baffle is coupled to the bottom of the hollow body and the planer baffle and wherein the vertical baffle has a height constant through the meandering path.

In one embodiment, the at least one vertical baffle is coupled to the bottom of the hollow body and the planer baffle and wherein the vertical baffle has a variable height through the meandering path.

In one embodiment, the hollow body of a musical instrument comprises a plurality of vertical baffles.

In one embodiment, the hollow body of a musical instrument comprises at least one C shaped baffle and at least one open P shaped baffled tied together with a third baffle.

In one embodiment, the meandering path has a first section in a first direction that transitions into a second section that travels in a second direction opposite the direction of the first section to form a first pair of alternating sections.

T In one embodiment, the meandering path has a third section and wherein the second section transitions into the third section that travels in a third direction to form a first V shape between the second and third sections.

In one embodiment, the meandering path has a fourth section that transitions into the third section and that travels in a fourth direction opposite the third direction to form a second pair of alternating sections.

In one embodiment, the meandering path has a fifth section and wherein the fourth section transitions into the fifth section that travels in a fifth direction to form a second V shape between the fourth and fifth.

In one embodiment, the hollow body has the soundboard that comprises at least one aperture only at an exit end of the meandering path.

In one embodiment, the soundboard comprises at least one aperture at an exit end of the meandering path and at least one aperture at an inlet into the meandering path, and wherein a ratio of cross sectional areas of the apertures is at least one of: 1/4, 1/2, 3/4, 1, 2, 3, and 4.

Additional aspects of the present invention will be apparent in view of the description which follows.

DETAILED DESCRIPTION

Figure 1:
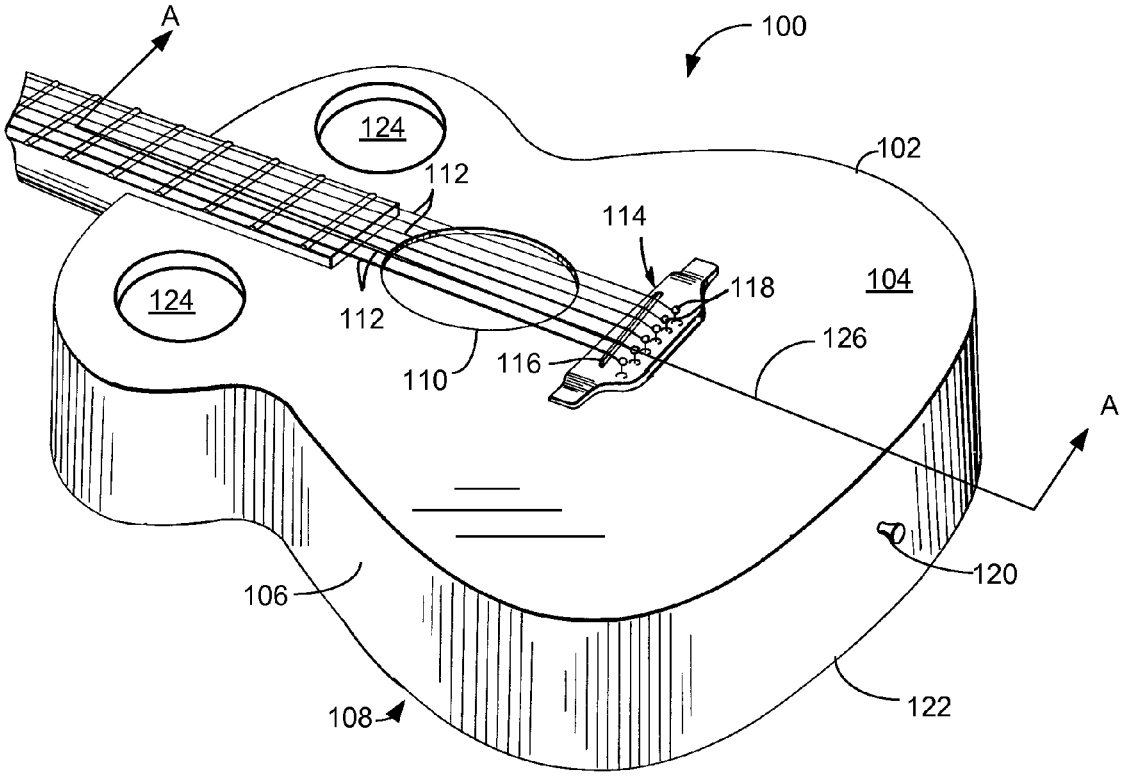
FIG. 1 is a perspective view of a stringed instrument according to at least one embodiment of the baffled instruments discussed herein.

Referring to FIG. 1, in at least one embodiment, the present application provides a stringed instrument 100 having a hollow body 102 with one or more apertures 110, 124. The body 102 is made up of a soundboard or top 104, a back 108, and sides 106. The instrument 100 further includes strings 112 that extend between the headstock and the tail block 122 of the instrument 100. The strings 112 are suspended a desired distance above the soundboard 104 with a bridge saddle 116. The bridge saddle 116 is supported on the soundboard 104 with a bridge 114. The bridge 114 generally secures the strings at the lower end of the body 102 and it amplifies the sound of the strings 112 by transferring the strings 122 vibrations to the soundboard 104. The strings 112 are secured to the bridge 114 through holes 118 therein. When one manipulates the strings of the instrument 100, the amplified sound resonates from the one or more apertures 110, 124.

Although a guitar may be discussed herein as an example of a stringed instrument, it is understood that various other stringed instruments can benefit from the present application, including a bass, cello, violin, etc. Additionally, the techniques discussed herein may be applied to non-stringed musical instruments. Accordingly, the present application is not limited to any one type of musical instrument.

The following convention will be used to describe the relationship between the parts of the musical instrument: "longitudinal" shall be a direction essentially inline with the tail block 122 and the head stock where "up" or "above" denotes a direction toward the headstock and "down" or "below" denotes a direction toward the tail block 122; "lateral" shall be a direction essentially perpendicular to the longitudinal direction; "horizontal" shall be a direction parallel with the plane of the soundboard; "vertical" shall be a direction perpendicular to the plane of the soundboard; "in" shall be a direction from the soundboard 104 toward the back 108; and "out" shall be a direction from the back 108 toward the soundboard 104.

Figure 2:
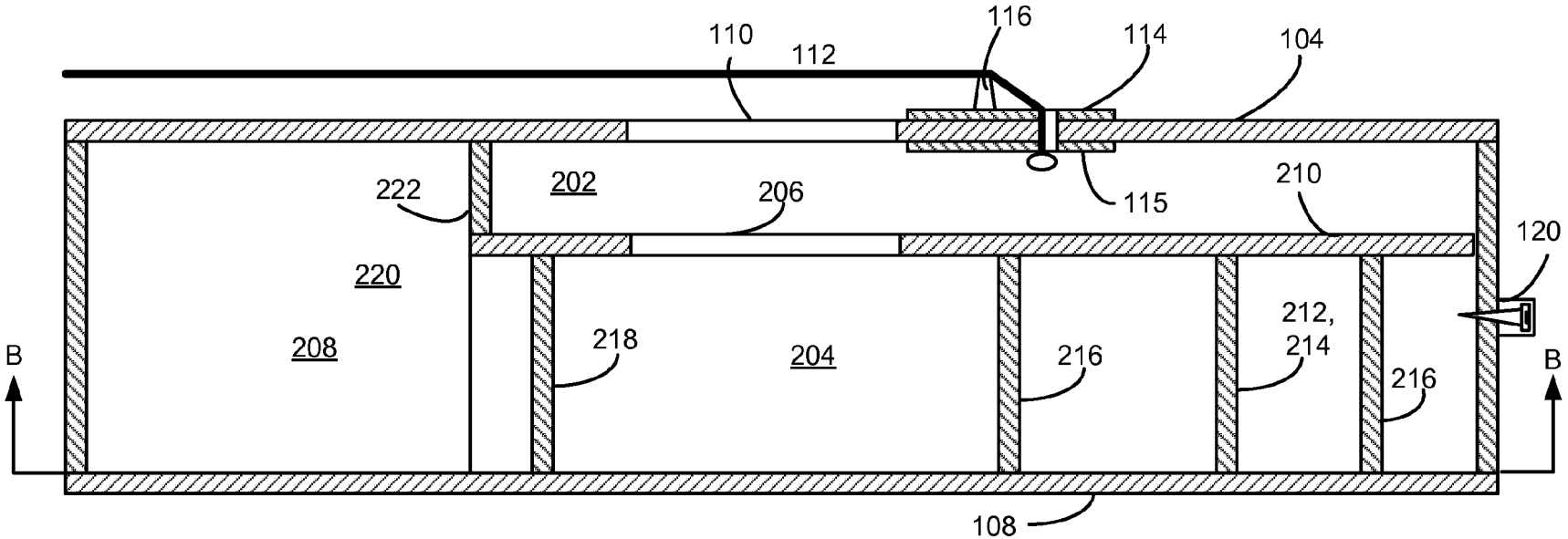
FIG. 2 is a cross sectional view of a stringed instrument according to at least one embodiment of the baffled instruments discussed herein.
Figure 3A:
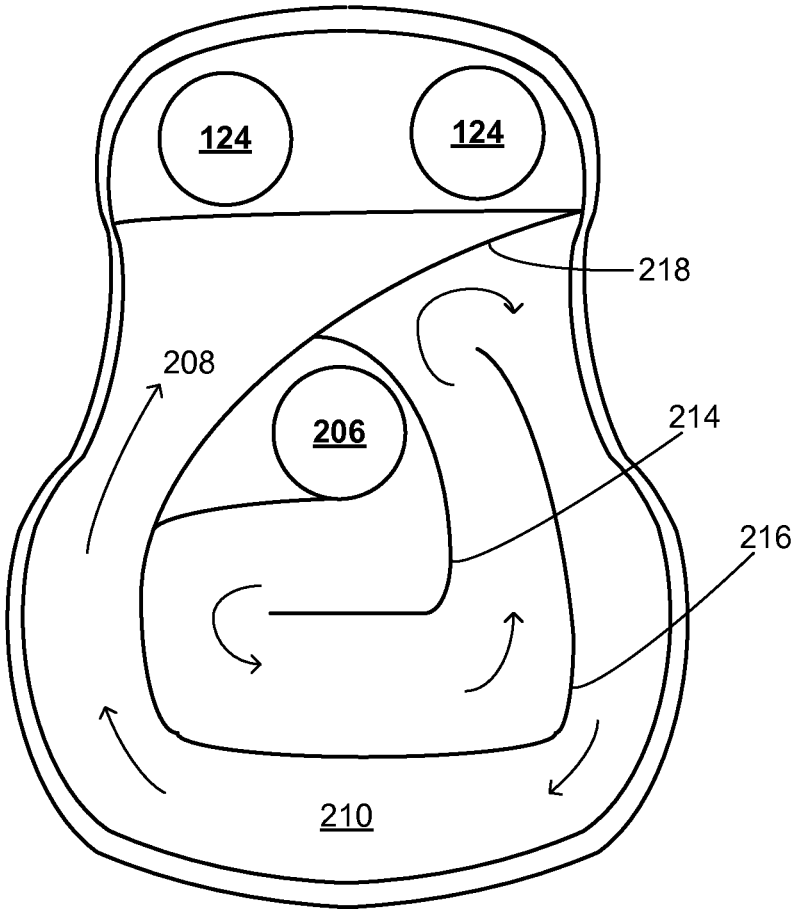
FIGS. 3*a-b* are cross sectional views of a stringed instrument according to at least one embodiment of the baffled instruments discussed herein.
Figure 3B:
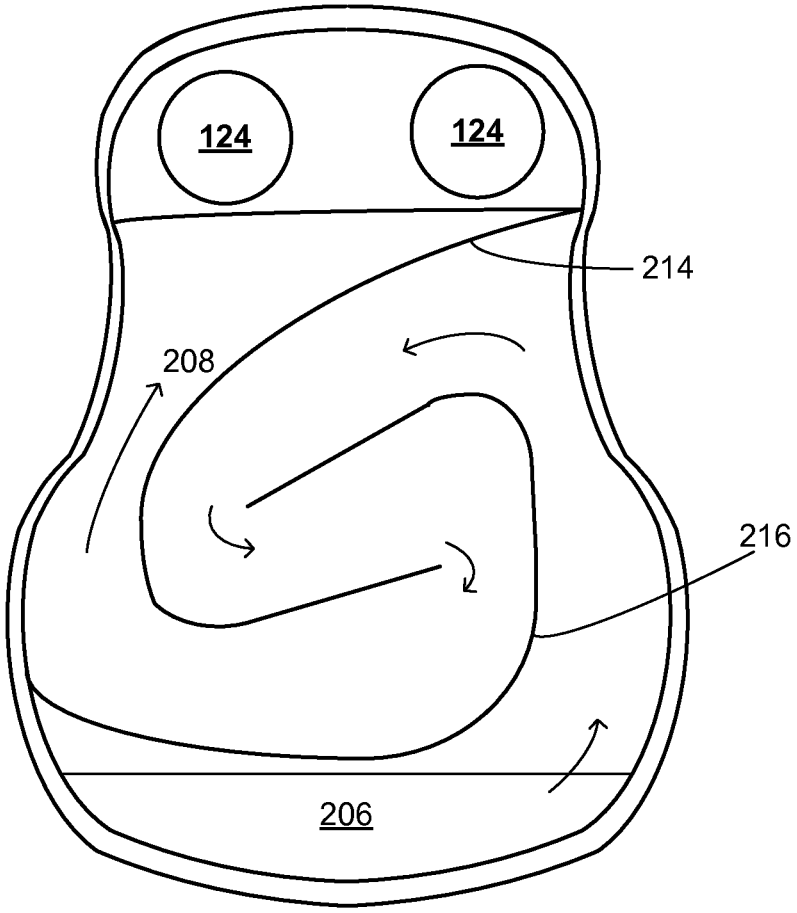

FIG. 2 is a cross sectional view A-A of musical instrument 100 of FIG. 1, which includes strings 112 that pass over the bridge saddle 116 and through holes in the bridge 114. In this instance, the instrument includes a bridge plate 115 disposed within the body 102 opposite the bridge 114. The holes 118 therefore pass through the bridge 114, the soundboard 104, and the bridge plate 115. FIGS. 3*a* and 3*b* are cross sectional views B-B of two embodiments of musical instrument 100 of FIG. 1.

Figure 4A:
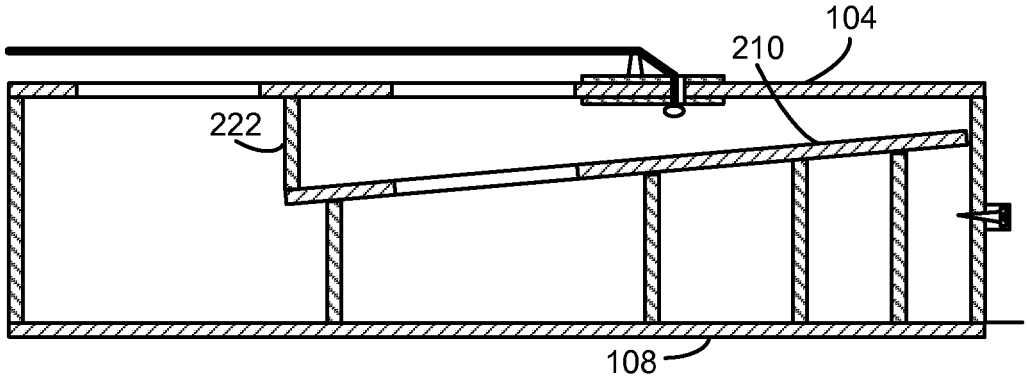
FIGS. 4*a-b* are cross sectional views of stringed instruments according to at least one embodiment of the baffled instruments discussed herein.
Figure 4B:
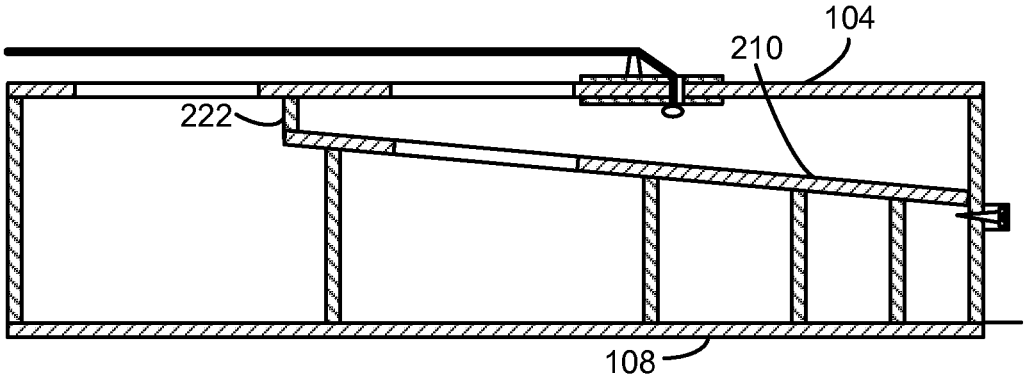

The instrument 100 preferably includes at least one vertical baffle 212, 214, 216, 218 within the hollow body 102 of the instrument 100, the at least one vertical baffle 212, 214, 216, 218 preferably directs and further amplifies or otherwise varies the frequency and/or the amplitude of, or generally the "color" of the sound created with the soundboard 104 as the sound passes through a meandering path 208 within the hollow body of the instrument 102. The instrument may further include a planer baffle 210. In this instance, the at least one vertical baffle 212, 214, 216, 218 is connected to both the bottom of the instrument 108 and the planer baffle 210. The planer baffle 210 generally separates the soundboard 104 from the meandering path 208 with a separation chamber 202 and maintains the volume of the meandering path 208 without the vertical baffles interfering with the vibration of the soundboard 104. The planer baffle 210 may be horizontal, i.e., parallel with the plane of the soundboard, or have a tilt therein such that the distance from the planer baffle 210 to the soundboard 104 at the hollow body 102 closer to the head stock is greater or smaller than the distance at the hollow body 102 closer to the tail stock, as shown in FIGS. 4*a* and 4*b* respectively.

In order to change the "color" of the sound from the soundboard 104, the meandering path 208 has a length and a cross sectional area that increases uniformly or otherwise between the inlet aperture 206 of the path 208 and the exit at 220 of the path 208. For example, the cross sectional area of the path 208 may increase such that the cross sectional area of the path 208 at A2 is greater than the cross sectional area of the path 208 at A1 to form an outwardly increasing taper. If the vertical height of the path 208 remains constant, the horizontal separation of the at least one vertical baffles 212, 214, 216, 218 would therefore increase toward the exit 220 of the path 208. The length of the path 208 is preferably proportional or otherwise based on the upper, lower, or average of the expected range of the frequency or wavelength of the musical instrument. For example, the length may be a function of ¼, ½, etc. of the wavelength of the musical instrument 100.

The meandering path 208 may be created in a variety of ways. Referring to FIG. 3*a*, the meandering path 208 may be created with a first, "C" shaped baffle 214 that interfaces with a second, open "P" shaped baffle 216. The first and the second baffles 214, 218 may further be tied together to a third baffle 218 that opens to a horn 220. In at least one embodiment, the meandering path 208 has a first section in a first direction that transitions into a second section that travels in a second direction, e.g., opposite the direction of the first section, forming a first pair of alternating sections. The second section may further transition into a third section in a third direction to form a first "V" shape between the second and third sections. The third section may transition into a fourth section that travels in a fourth direction, e.g., opposite the direction of the third section, forming a second pair of alternating sections. The fourth section may further transition into a fifth section in a fifth direction to form a second "V" shape between the fourth and fifth sections, and the fifth section may transition into a sixth section in a sixth direction to form a third "V" shape between the fifth and sixth sections, as shown in FIG. 3*a*. Sound exiting the path 208 at 220 resonates from the instrument through apertures 124, preferably facing outward from the soundboard or otherwise. The planer baffle 210 may further be coupled to the soundboard with a partition 222 that separates the entry of the meandering path 208 from the exit to allow the apertures 204 to provide an exit out of the top or soundboard of the instrument. FIG. 3*b* shows a meandering path in an "S" shape with the inlet aperture 206 at the bottom of the hollow body of the guitar (near the tail stock).

The size of the apertures 110, 124 may vary, ultimately to tailor the sound emitted from the apertures 110, 124 as desired. For example, the instrument 100 may have a one or more apertures 124 only at the exit end of the meandering discussed herein, i.e., without an aperture 110. Alternatively, the aperture 110 at the entrance of the meandering path, e.g., in the soundboard and/or in the planer baffle 210, and the aperture(s) 124 at the exit of the path may have cross sectional areas that are a desired ratio to each other, e.g., 1/4, 1/2, 3/4, 1, . . . , 2, 3, 4 . . . , etc.

Figure 5A:
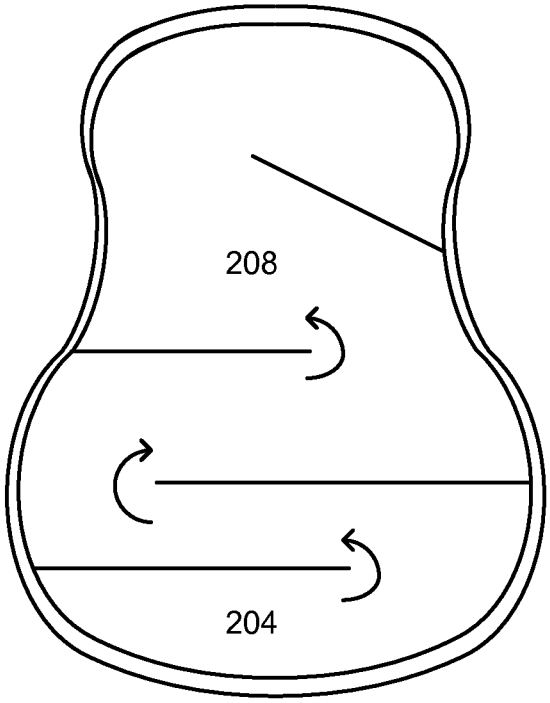
FIGS. 5*a-b* are cross sectional views of stringed instruments according to at least one embodiment of the baffled instruments discussed herein.
Figure 5B:
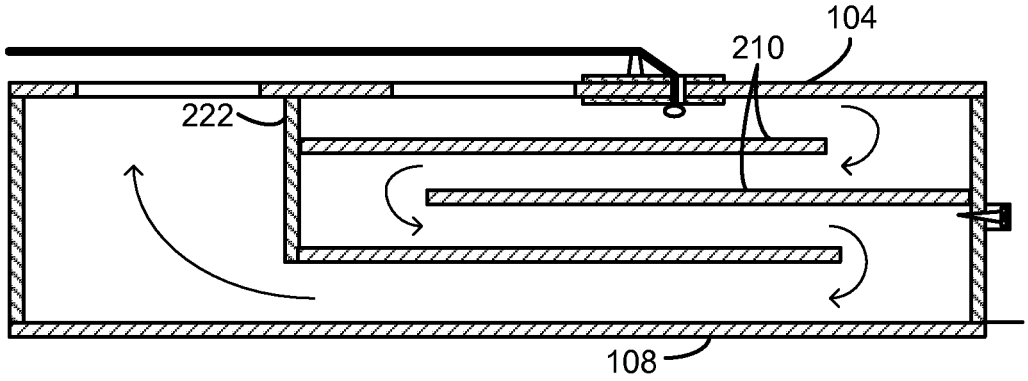

The meandering path 208 may also be a series of parallel vertical baffles as shown in FIG. 5*a*. In this instance, the increasing cross sectional area may be achieved with a planer baffle 210 that tilts upward as shown in FIG. 4*b* so that successive parallel portions of the meandering path 208 may have a height that increases as a result of the increase in the distance between the bottom 108 of the instrument and the planer baffle 210. The meandering path 208 may also be created with a series of planer baffles parallel or tilted relative to the soundboard as shown in FIG. 5*b*.

The baffles may be made from a variety of different types of material. For example, the baffles may be made from ⅛" to ¼" hardwood or plywood that is curved appropriately. Alternatively, the baffles may be molded from wood fibers and/or synthetic materials.

While the foregoing has been described in some detail for purposes of clarity and understanding, it will be appreciated by one skilled in the art, from a reading of the disclosure, that various changes in form and detail can be made without departing from the true scope of the invention in the appended claims.

The invention claimed is:

1. A hollow body of a musical instrument, the hollow body comprising a top and a bottom, at least one vertical baffle forming a meandering path within the hollow body of the musical instrument between the top and bottom of the hollow body, and a planer baffle located within the hollow body such that a separation chamber created therewith separates the soundboard from the meandering path and the planer baffle maintains the volume of the meandering path such that the at least one vertical baffle does not interfere with vibration of the soundboard, wherein the top of the hollow body comprises a soundboard of a stringed instrument and wherein the at least one vertical baffle directs sound created with the soundboard through the meandering path within the hollow body of the instrument;

wherein the meandering path has a length and a cross sectional area that increases between an inlet aperture of the meandering path and an exit of the meandering path; and wherein the length of the meandering path is one of ¼ and ½ of an average wavelength sound created with the musical instrument.

2. The hollow body of a musical instrument of claim 1, wherein the planer baffle is one of parallel with a plane of the sound board or tilted relative to the plane of the sound board.

3. The hollow body of a musical instrument of claim 1, wherein the meandering path has a length and a cross sectional area that increases between an inlet aperture of the meandering path and an exit of the meandering path.

4. The hollow body of a musical instrument of claim 1, wherein the cross sectional area further creates an outwardly increasing taper at least at the exit of the meandering path.

5. A hollow body of a musical instrument, the hollow body comprising a top and a bottom, at least one vertical baffle forming a meandering path within the hollow body of the musical instrument between the top and bottom of the hollow body, and a planer baffle located within the hollow body such that a separation chamber created therewith separates the soundboard from the meandering path and the planer baffle maintains the volume of the meandering path such that the at least one vertical baffle does not interfere with vibration of the soundboard, wherein the top of the hollow body comprises a soundboard of a stringed instrument and wherein the at least one vertical baffle directs sound created with the soundboard through the meandering path within the hollow body of the instrument, wherein the at least one vertical baffle is coupled to the bottom of the hollow body and the planer baffle and wherein the vertical baffle has a height constant through the meandering path.

6. The hollow body of a musical instrument of claim 5, comprising a plurality of vertical baffles.

7. The hollow body of a musical instrument of claim 5, comprising at least one C shaped baffle and at least one open P shaped baffled tied together with a third baffle.

8. The hollow body of a musical instrument of claim 7, the meandering path having a first section in a first direction that transitions into a second section that travels in a second direction opposite the direction of the first section to form a first pair of alternating sections.

9. The hollow body of a musical instrument of claim 8, the meandering path having a third section and wherein the second section transitions into the third section that travels in a third direction to form a first V shape between the second and third sections.

10. The hollow body of a musical instrument of claim 9, the meandering path having a fourth section that transitions into the third section and that travels in a fourth direction opposite the third direction to form a second pair of alternating sections.

11. The hollow body of a musical instrument of claim 10, the meandering path having a fifth section and wherein the fourth section transitions into the fifth section that travels in a fifth direction to form a second V shape between the fourth and fifth.

12. A hollow body of a musical instrument, the hollow body comprising a top and a bottom, at least one vertical baffle forming a meandering path within the hollow body of the musical instrument between the top and bottom of the hollow body, and a planer baffle located within the hollow body such that a separation chamber created therewith separates the soundboard from the meandering path and the planer baffle maintains the volume of the meandering path such that the at least one vertical baffle does not interfere with vibration of the soundboard, wherein the top of the hollow body comprises a soundboard of a stringed instrument and wherein the at least one vertical baffle directs sound created with the soundboard through the meandering path within the hollow body of the instrument, wherein the at least one vertical baffle is coupled to the bottom of the hollow body and the planer baffle and wherein the vertical baffle has a variable height through the meandering path.

13. A hollow body of a musical instrument, the hollow body comprising a top and a bottom, at least one vertical baffle forming a meandering path within the hollow body of the musical instrument between the top and bottom of the hollow body, and a planer baffle located within the hollow body such that a separation chamber created therewith separates the soundboard from the meandering path and the planer baffle maintains the volume of the meandering path such that the at least one vertical baffle does not interfere with vibration of the soundboard, wherein the top of the hollow body comprises a soundboard of a stringed instrument and wherein the at least one vertical baffle directs sound created with the soundboard through the meandering path within the hollow body of the instrument, wherein the soundboard comprises at least one aperture only at an exit end of the meandering path.

14. A hollow body of a musical instrument, the hollow body comprising a top and a bottom, at least one vertical baffle forming a meandering path within the hollow body of the musical instrument between the top and bottom of the hollow body, and a planer baffle located within the hollow body such that a separation chamber created therewith separates the soundboard from the meandering path and the planer baffle maintains the volume of the meandering path such that the at least one vertical baffle does not interfere with vibration of the soundboard, wherein the top of the hollow body comprises a soundboard of a stringed instrument and wherein the at least one vertical baffle directs sound created with the soundboard through the meandering path within the hollow body of the instrument, wherein the soundboard comprises at least one aperture at an exit end of the meandering path and at least one aperture at an inlet into the meandering path, and wherein a ratio of cross sectional areas of the apertures is at least one of: ¼, ½, ¾, 1, 2, 3, and 4.

* * * * *